US005419160A

United States Patent [19]

Fildan

[11] Patent Number: 5,419,160

[45] Date of Patent: May 30, 1995

[54] JEWELED GARMENT LINK AND METHOD OF MAKING SAME

[76] Inventor: Gerhard Fildan, Wohnpark Alte Arlaa, Anton Baumgartner St. 44, C4 17 01, A-1232 Vienna, Austria

[21] Appl. No.: 154,949

[22] Filed: Nov. 19, 1993

[51] Int. Cl.[6] ..... A44C 17/02; A44C 17/00

[52] U.S. Cl. ..... 63/28; 63/2; 63/DIG. 3

[58] Field of Search ..... 63/2, 21, 22, 28, 26; 24/163 K, 198, 169; 59/900; 224/164, 173, 163

[56] References Cited

U.S. PATENT DOCUMENTS

| | | | |
|---|---|---|---|
| D. 139,671 | 12/1944 | Pereira | 224/164 |
| 843,006 | 2/1907 | Dover | 63/28 |
| 1,013,059 | 12/1911 | Publicker et al. | 224/163 |
| 1,589,423 | 6/1926 | Payton | 63/26 |
| 2,051,591 | 8/1936 | Brogan | 63/2 |
| 2,080,317 | 5/1937 | Jaeckel | 63/26 |
| 2,536,206 | 1/1951 | Newhouse | 63/26 |
| 2,920,442 | 1/1960 | Kunzmann et al. | 63/28 |
| 3,365,877 | 1/1968 | Altman | 224/173 |
| 4,400,932 | 8/1983 | Epstein | 63/28 |
| 5,099,660 | 3/1992 | Dostourian | 63/28 |

FOREIGN PATENT DOCUMENTS

| | | | |
|---|---|---|---|
| 0527111 | 2/1993 | European Pat. Off. | 63/26 |
| 764966 | 5/1934 | France | 63/26 |
| 1172990 | 2/1959 | France | 59/900 |

*Primary Examiner*—Michael J. Milano
*Attorney, Agent, or Firm*—Herbert Dubno

[57] ABSTRACT

A decorative garment link for lingerie, swimsuits or the like is formed by anchoring a row of ornamental stones between two lateral walls of an elongated base from which a pair of strap-receiving loops project laterally. The lateral walls are pressed against the stones to hold them in place and are fused together or to respective end walls at the ends of the row of stones.

7 Claims, 1 Drawing Sheet

JEWELED GARMENT LINK AND METHOD OF MAKING SAME

FIELD OF THE INVENTION

The present invention relates to a decorative garment link, especially for use between two straps on a swimsuit or lingerie or underwear article and, more particularly, to a jeweled garment link in which ornamental stones, e.g. simulating diamonds, can be provided between two strap-engaging loops. The invention also relates to a method of making the improved decorative garment link.

BACKGROUND OF THE INVENTION

It has become common practice to provide brassieres, slips, other items of underwear or lingerie and swimsuits with decorative garment links which are generally disposed between two straps and facilitate adjustment of the garment to the wearer. In general, such a garment link which may or may not be separable and can also form a catch, comprises two loops which are molded in a single piece or on respective parts of the catch, and can be disposed on opposite sides of a region which can carry some type of decoration.

In a so-called jeweled garment link, that decoration may be one or more diamond-simulating stones, more or less facetted, which are anchored in the link.

For the most part, such stones have projected well above the body in which they were anchored. In one prior art construction, the stones were seated within an apron which extended upwardly only around a base of the stone with a substantial portion of the stone projecting above the surrounding wall of the seat. The seat could be provided as part of a stud, a pin or which could be fitted into a hole in the central portion of the garment link and fused or otherwise anchored in place.

Garment links of this construction had the drawback that the stone could snag on other garments of the wearer or during dressing, damaging finer garments or resulting in damage to the link if the stone could be pulled out by the snagging action.

The earlier garment link allowed accumulation of lint or dirt as well.

OBJECTS OF THE INVENTION

It is, therefore, the principal object of the present invention to provide an improved garment link whereby the drawbacks of earlier decorative links as described above, are obviated.

Still another object of the invention is to provide a decorative garment link which can be fabricated at low cost, but in which snagging of the ornamental stone or stones used to decorate the garment link, is precluded.

It is also an object of this invention to provide an improved method of making a garment link.

SUMMARY OF THE INVENTION

These objects and others which will become apparent hereinafter are attained, in accordance with the invention, by providing a central region of a garment link body, between two strap-engaging loops, with at least one pair of walls adapted to flank an ornamental stone or row of ornamental stones and which retain the stone or stones by being inwardly convergent, i.e. by being pressed toward one another to grip the stone or stones between them.

Advantageously, the walls are fused together at the ends at the row or the ends of the walls are fused to other walls which press on the end stone of the row as part of the anchoring process.

In all embodiments, the top of the stone is flush with the top of the walls or recessed slightly below the tops of the walls so that no portion of any of the ornamental stones projects above the tops of the wall.

The term "ornamental stone" as used herein is intended to refer to any small object resembling a jewel including a gemstone or simulated gemstone, glass or rhinestone, or like object which is utilized in a decorative manner, can catch light or has a decorative color, and preferably is facetted. More particularly, a decorative garment link can comprise:

a synthetic-resin body formed with an elongated central base and a pair of loops flanking the base and adapted to receive respective straps of a garment;

a row of ornamental stones seated in the base between the loops; and a pair of lateral walls flanking the row, pressed inwardly against the ornamental stones and extending from the base at least to a level of tops of the stones.

Advantageously, the lateral walls are unitary with the base and the base can be formed with a pair of end walls pressed against respective end stones of the row.

These end walls can be fused to the lateral walls or the lateral walls can be fused together at opposite ends of the row. In a preferred embodiment of the invention, three ornamental stones constitute the row.

The loops can be elongated parallel to the base.

The method of making a garment link can comprise the steps of:

molding a synthetic-resin body with an elongated central base, a pair of loops flanking the base and adapted to receive respective straps of a garment, and a pair of spaced-apart walls extending from the base;

disposing a row of ornamental stones on the base between the walls;

anchoring the ornamental stones to the base by pressing the walls toward one another and against the ornamental stones; and fusing the walls at opposite ends of the row to prevent spreading of the walls.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
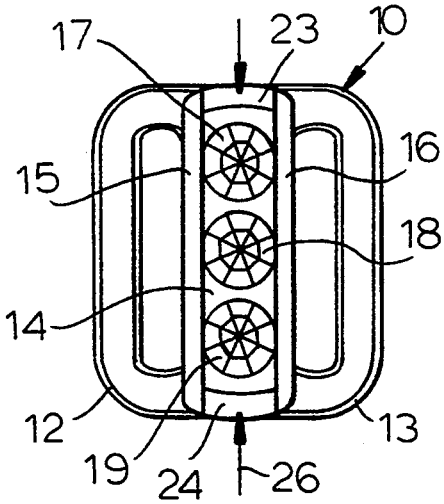
FIG. 1 is an elevational view of a garment link embodying the present invention.

In FIG. 1 I have shown a garment link 10 which comprises a body 11 formed with a pair of loops or eyes 12 and 13 molded unitarily with a base 14 which extends centrally between the linked loops. Through each of the loops a respective strap of an article of lingerie or a swimsuit can pass, adjustable by a buckle, if desired. When the garment link is utilized between two cups of a brassiere, it may be a unitary structure as shown. For maternity brassieres, for example, the garment link can be separated into two parts which can be joined together by a catch structure (not shown).

Figure 2:
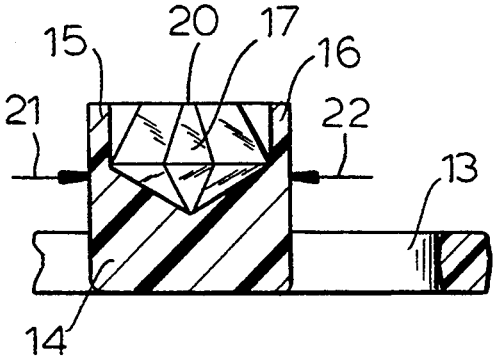
FIG. 2 is a cross sectional view through a portion of the base and one loop of the garment link of FIG. 1, drawn to a greatly enlarged scale.

As can be seen from the drawing, in the central bar of the link, the base 14 can be provided with a pair of upstanding walls 15 and 16 flanking a row of ornamental stones 17, 18 and 19, only one of which can be seen in FIG. 2. The stones 17–19 can be faceted as shown in FIG. 2 and have their upper parts 20 lying flush with the tops of the walls 15, 16 or recessed slightly therebelow.

To secure the stones in place, the walls 15 and 16 may be plastically deformed inwardly by hot pressing to partly mold these walls around the row of stones. The inward pressing is represented by the arrows 21 and 22 in FIG. 2.

Figure 3:
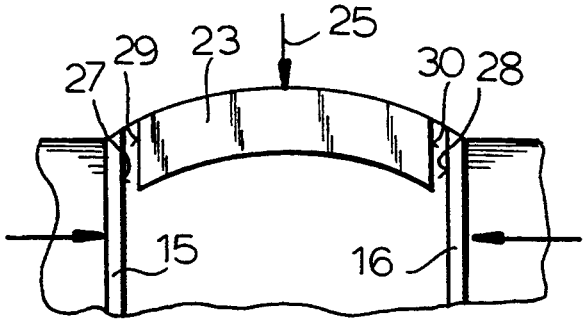
FIG. 3 is a detail view showing the relationship between a pair of lateral walls and one of the end walls, drawn to a still greater scale.

As can be seen from FIGS. 1 and 3, at the ends of the row, respective end walls 23 and 24 can be provided. These end walls can also be pressed inwardly against the end stones as represented by the arrows 25 and 26 to be partially molded around the end stones of the row.

The body of the link can be injection-molded from a thermoplastic and the inward pressing of the walls can be effected by hot pressing or with the aid of inductive heating to effect a permanent deformation of the walls to anchor the stones in place.

When the walls 15 and 16 are pressed inwardly, faces 27 and 28 of the walls 15 and 16 confronting the faces 29 and 30 of the end walls 23 and 24 can be pressed together so that the lateral walls 15 and 16 are fused to the end walls at respective junctions as shown in FIG. 1.

Figure 5:
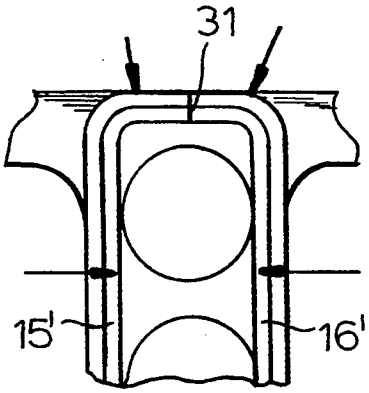
FIG. 5 is a detail view similar to FIG. 3 but of an embodiment without end walls, the stones having been omitted.

As can be seen from FIG. 5, the lateral walls 15' and 16' can be pressed inwardly and can be deformed at the ends of the rows to provide a fused junction at 31 as an alternative to the use of separate end walls.

Figure 4:
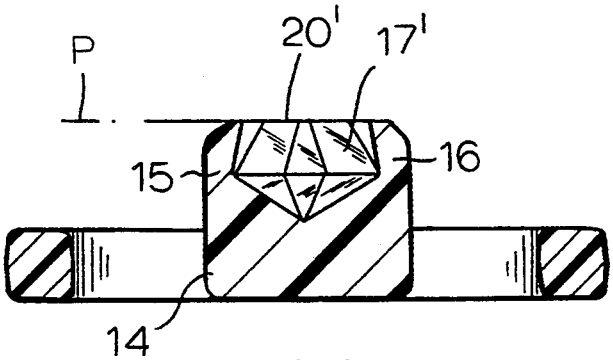
FIG. 4 is a view similar to FIG. 2 and at approximately the same scale thereof wherein the stone is seated below the tops of the walls.

FIG. 4 shows the anchoring of a stone 17' between a pair of lateral walls 15, 16 of a base 14 of a garment link, where the upper surface 20' lies slightly below a plane P of the tops of the walls 15 and 16, the garment link of FIG. 4 being otherwise similar to that of FIG. 1. In the process of making the garment link of the invention, the synthetic resin body is in each case molded with the linked central base and the pair of linked loops flanking the base and at least the pair of lateral spaced-apart walls which extend from the base. The ornamental stones are then set on the base between the walls and are anchored by hot pressing the walls toward one another and against the ornamental stones. The inwardly-pressed lateral walls are held in place by fusing the walls at opposite ends of the row together or to respective end walls.

I claim:

1. A decorative garment link, comprising:

a synthetic-resin body formed with an elongated central base and a pair of D-shaped loops laterally flanking said base and having openings parallel to the base and adapted to receive respective straps of a garment;

a row of ornamental stones seated in said base between said loops;

a pair of lateral walls unitary with said base and flanking said row, pressed inwardly against said ornamental stones and extending from said base at least to a level of tops of said stones; and a pair of end walls pressed against respective end stones of said row, each, of said end walls having respective fusion seams at junctions with said lateral walls.

2. The decorative garment link defined in claim 1 wherein three of said ornamental stones are provided in said row.

3. The decorative garment link defined in claim 1 wherein said ornamental stones are facetted simulated gemstones.

4. A decorative garment link, comprising:

a synthetic-resin body formed with an elongated central base and a pair of D-shaped loops laterally flanking said base and having openings parallel to the base and adapted to receive respective straps of a garment;

a row of ornamental stones seated in said base between said loops;

a pair of lateral walls unitary with said base and flanking said row, pressed inwardly against said ornamental stones and extending from said base at least to a level of tops of said stones; and a respective fusion seam between said walls at opposite ends of said row.

5. A method of making a decorative garment link, comprising the steps of:

molding a synthetic-resin body with an elongated central base, a pair of loops flanking said base and adapted to receive respective straps of a garment, and a pair of spaced apart walls extending from said base;

disposing a row of ornamental stones on said base between said walls;

anchoring said ornamental stones to said base by pressing said walls toward one another and against said ornamental stones; and fusing said walls at opposite ends of said row to prevent spreading of said walls.

6. The method defined in claim 5 wherein said lateral walls are fused to end walls pressed inwardly against end ornamental stones at opposite ends of said row.

7. The method defined in claim 5 wherein ends of said lateral walls are fused together at ends of said row.

* * * * *